United States Patent [19]

Silkey

[11] 4,214,718

[45] Jul. 29, 1980

[54] WIRE REEL SUPPORT BRACKETS

[76] Inventor: Bruce A. Silkey, Rte. 1, Box 162A, Lawrence, Kans. 66044

[21] Appl. No.: 23,150

[22] Filed: Mar. 23, 1979

[51] Int. Cl.[2] ..... B65H 49/00

[52] U.S. Cl. ..... 242/129.6; 248/217.1

[58] Field of Search ..... 242/129.5–130; 248/216.1, 216.4, 217.1, 217.3, 218.4, 211

[56] References Cited

U.S. PATENT DOCUMENTS

| | | | |
|---|---|---|---|
| 141,498 | 8/1873 | Edmonston | 248/216 |
| 3,156,443 | 11/1964 | Lupinacci | 248/211 |
| 3,383,071 | 5/1968 | Godson | 242/129.6 |
| 3,902,568 | 9/1975 | Erickson | 248/216 |
| 4,132,372 | 1/1979 | Worrell | 242/129.62 |

*Primary Examiner*—Leonard D. Christian

*Attorney, Agent, or Firm*—Schmidt, Johnson, Hovey & Williams

[57] ABSTRACT

An inexpensive, easily installable wire reel support structure and bracket therefor is disclosed which permits the user to quickly and securely mount a heavy reel of electrical wire or the like between upright members such as wooden studs. The support structure includes a pair of generally L-shaped brackets adapted to fit on and engage respective studs, with one projecting arm of the bracket being obliquely oriented and adjacent the proximal stud face; an elongated, reel-supporting pipe extends between the stud-mounted brackets and is disposed between and engages the respective oblique bracket arms and corresponding stud faces. The weight of the wire reel thus firmly anchors the structure on the studs and allows the wire to be unwound from the reel as desired without fear of dislodging the reel or upsetting the support structure.

5 Claims, 3 Drawing Figures

WIRE REEL SUPPORT BRACKETS

BACKGROUND OF THE INVENTION

1. Field of the Invention

The present invention is concerned with a support structure and specialized bracket designed for rotatably supporting reels of electrical wire or the like. More particularly, it is concerned with such a support structure and bracket therefor which are especially configured for supporting a reel of electrical wire between adjacent studs during construction of a house or other building in order to allow the wire to be unwound as desired during wiring of the building.

2. Description of the Prior Art

Electrical wire or cable used in wiring houses or other buildings is sold in large reels in lengths of, for example, one thousand feet. As can be appreciated, such large reels are extremely bulky and difficult to handle. To give but one example, a one thousand foot reel of 12/2 grounded Romex wire weighs approximately one hundred pounds. Thus, in order to be efficiently used, such large reels of wire must be mounted and supported so that desired lengths of the wire can be easily removed from the reel.

Specialized, tripod-type reel-supporting constructions have been proposed in the past. However, these units suffer from the drawbacks of relative costliness and the bulky, unwieldy nature thereof. As can be appreciated, in order to adequately support relatively heavy wire reels, freestanding support units of this type must be heavy and bulky themselves.

Another expedient resorted to in the past is to simply drive large nails into adjacent studs, and mount a reel-supporting pipe thereon. This is less than optimum because of the inherent lack of strength of the construction, and the tendency of the reel to fall during unwinding of wire therefrom.

It will also be recognized that a successful wire reel support structure must adequately support the wire reel even in the event that upwardly directed tensile force is exerted upon the reel, as would occur when a reel is located on a lower floor and an electrician on an upper floor pulls a section of wire from the reel. In like manner, sections of wire can be pulled from virtually any direction, and the support structure must of course withstand any such tensile loads.

U.S. Pat. No. 3,383,071 describes a wire dispenser of freestanding, tripod construction. A principal objection to units of the type described in this patent stems from their cost and relative bulkiness. Other prior U.S. patents describing support structures of various types include U.S. Pat. Nos. 3,156,443, 3,902,568, and 141,498.

SUMMARY OF THE INVENTION

The present invention overcomes the difficulties discussed above by provision of reel-supporting structures including a pair of spaced, upright members (preferably spaced wooden studs), a bracket mounted on each upright member respectively, and an elongated reel-supporting element spanning the bracket for rotatably supporting a wire reel. The brackets each include a pair of spaced, opposed, member-engaging surfaces, and an upright arm which is proximal to a face or surface of the adjacent member. The elongated reel-supporting element (in practice a length of pipe) is wedged between and engages the bracket arms and member faces for securely holding the element, and thereby the wire reel supported thereby, in place.

A prime feature of the present invention is the simple nature thereof which permits the specialized brackets to be mounted on adjacent studs during construction of a building, with the support structure being completed by passing a length of pipe through the axial bore of a reel of wire, and mounting the opposed ends of the pipe within the stud-mounted bracket. Thus, a safe, secure support structure is provided with the reel which is not only inexpensive but supports the reel in an unobtrusive location between structural studs, as opposed to a freestanding unit which requires significant floor space.

DESCRIPTION OF THE PREFERRED EMBODIMENT

Figure 1:
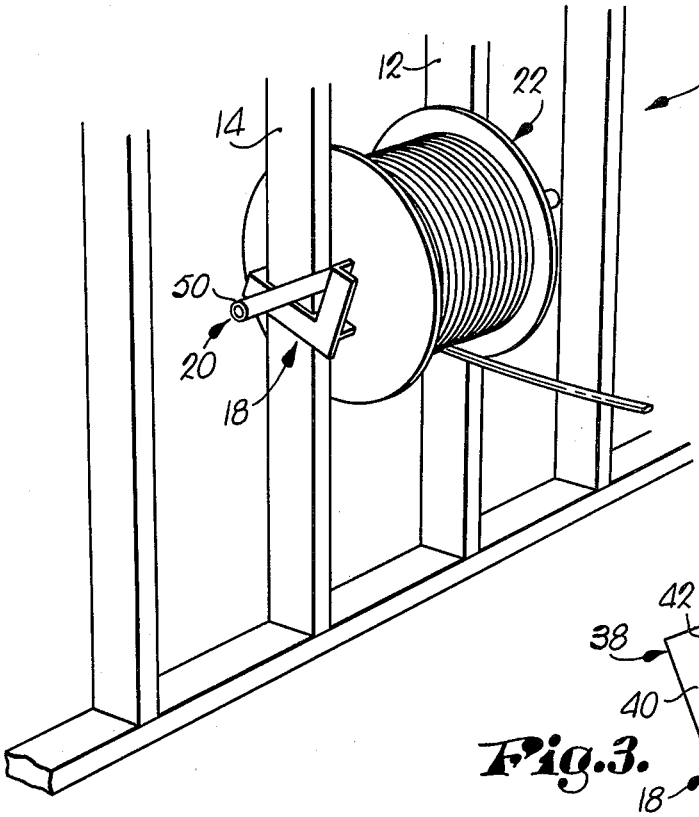
FIG. 1 is a perspective view of the preferred reel-supporting structure of the present invention.

Referring now to the drawing, reel-supporting structure 10 in accordance with the invention is illustrated in FIG. 1 and broadly includes a pair of spaced, wooden studs 12, 14, a pair of brackets 16, 18 respectively mounted on the studs 12, 14, and an elongated reel-support element 20 spanning the studs 12, 14, and in engagement with the latter and the respective brackets 16, 18. A standard reel 22 of electrical wire is rotatably positioned on the element 20 in order to allow the wire to be unwound as desired for use.

The studs 12, 14, are entirely conventional and include wide sidewall surfaces 24, 26, and spaced, opposed, narrower sidewall surfaces 28, 30. The studs are mounted in upright fashion and are spaced apart a standard distance.

Figure 3:
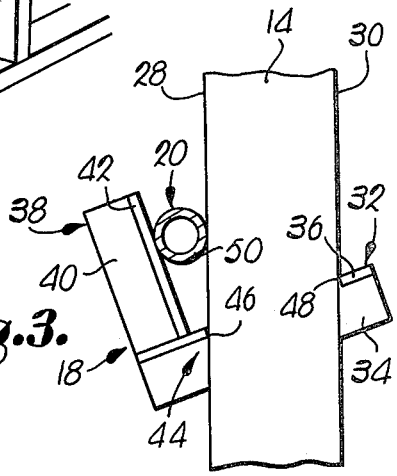
FIG. 3 is a sectional view taken along line 3—3 of FIG. 2 which illustrates in detail the construction of one of the stud-mounted brackets of the invention.
Figure 2:
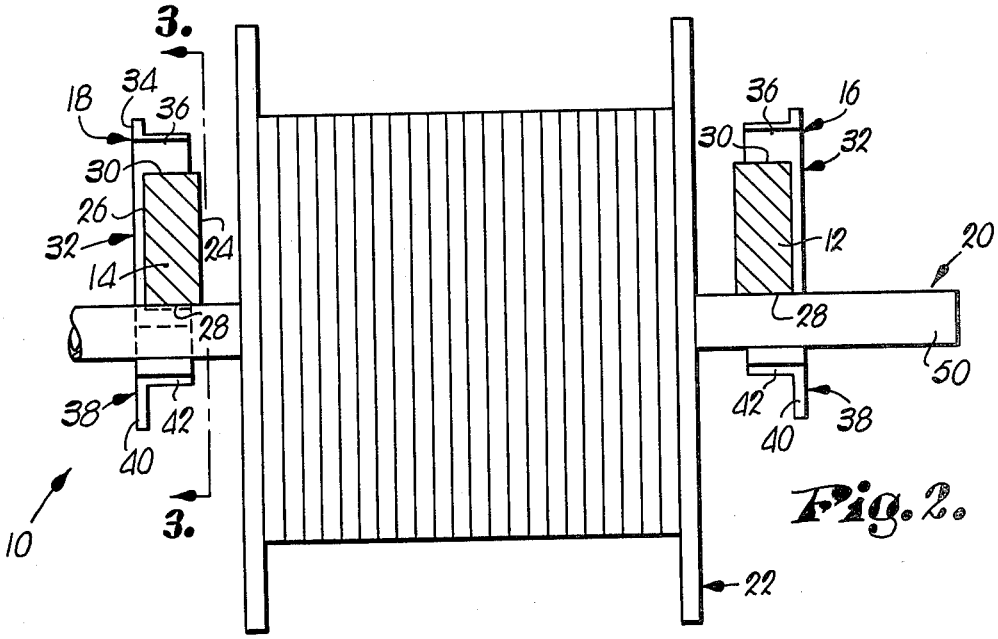
FIG. 2 is a top view of the structure illustrated in FIG. 1.

Each bracket 16, 18, is formed of angle iron of generally L-shaped cross section which is defined by interconnected, elongated legs. As best seen in FIG. 3, the bracket 18 includes an elongated, first support section 32 made up of planar, normally oriented legs 34, 36. In addition, the bracket 18 includes a second support section or arm 38 which is disposed adjacent one end of the section 32 and comprises planar, interconnected, normally oriented legs 40, 42. As will be seen from a study of FIG. 3, the planar segments represented by the legs 36, 42, are disposed at about a 90 degree angle to one another.

The leg 36 of first support section 32 is provided with a rectangular recess referred to generally by the numeral 44 which presents a pair of spaced, opposed, rectilinear stud-engaging edges or surfaces 46, 48. The spacing between the surfaces 46, 48 is greater than the width of a corresponding stud 14 between the faces 28, 30 thereof; thus, when the bracket 18 is mounted on the stud 14, first support section 32 is obliquely oriented as viewed in FIG. 3 in order to establish engagement between the surfaces 46, 48 and the faces 28, 30. This in turn obliquely orients the upright support section or arm 38 relative to the face 28 of adjacent stud 14.

The bracket 16 is simply a mirror image of the bracket 18 and thus need not be described in detail. By virtue of this construction however, the brackets 16, 18 are handed, and therefore a matched set of the brackets is employed in the invention. Similarly, the mounting and orientation of bracket 16 on stud 12 is exactly as described in connection with bracket 18 and stud 14.

The element 20 in preferred forms is simply an elongated section of pipe 50 of sufficient length to span the studs 12, 14. Of course, the pipe 50 must be of a diameter sufficient to pass through the central axial bore of the wire reel 22 and allow the latter to rotate.

In the use of reel-supporting structure 10, an appropriate pair of studs 12, 14 are selected, whereupon the corresponding brackets 16, 18 are mounted on the studs. This simply involves placing the appropriate bracket around the stud and turning the bracket downwardly as viewed in FIG. 3 such that the surfaces 46, 48 engage the stud faces 28, 30. At this point the pipe 50 is passed through the center of the wire reel 22, whereupon the opposed projecting ends of the pipe are wedged between and engage the respective bracket arms and studs. As will be appreciated, the considerable weight of the reel places a torque on the respective brackets 16, 18, and this in turn creates a firm, secure engagement between the surfaces 46, 48 and the stud faces 28, 30. Wire from reel 22 can then be withdrawn as desired, from any position above or around the reel. The extreme stability of the reel-supporting structure of the invention permits unwinding of wire from the reel 22 without fear of dislodgement or upsetting of the reel. Furthermore, use of left and right handed brackets in accordance with the invention, which as illustrated are mounted on the faces of the studs remote from the reel, minimizes the possibility of interference as wire is unwound from the reel.

Brackets 16 and 18 may also be mounted on studs which are located on opposite sides of an intermediate stud thus permitting two reels 22 to be mounted side-by-side on a single supporting rod or pipe element 20. The user may then remove wire from a selected reel independently of the other.

It has been found that the wedging action which occurs when the pipe or rod support element 20 is forced down into the V-shaped space between arm 38 of each bracket 16 or 18 and a corresponding stud is important to the functioning of the present invention by virtue of the fact that element 20 is thus firmly held in position regardless of the direction in which the wire is pulled from reel 22 (including upwardly toward an upper floor) and there is no problem of the rod working loose from the brackets and thus releasing the reel 22.

Having thus described the invention, what is claimed as new and desired to be secured by Letters Patent is:

1. Structure for rotatably supporting a reel of electrical wire or the like, comprising:

a pair of spaced, upright members each presenting a pair of spaced, opposed faces;

a bracket mounted on each member respectively and including a pair of spaced, opposed, surfaces for respectively engaging said faces of the corresponding member, and an upright arm proximal to one of said faces;

an elongated, reel-supporting element spanning said members and wedged between and in engagement with each of said one faces and the proximal bracket arms for securely holding said element in place.

2. Structure as set forth in claim 1 wherein the spacing between said bracket surfaces is greater than the spacing between said member faces, whereby said bracket is inclined to establish said engagement between said bracket surfaces and member faces.

3. Structure as set forth in claim 2 wherein said arms are obliquely oriented relative to the corresponding adjacent member faces.

4. Structure as set forth in claim 1 wherein said members are wooden studs, and said faces are the narrower sidewall surfaces thereof.

5. Structure as set forth in claim 1 wherein each of said brackets is formed at least in part of angle iron of generally L-shaped cross section and defined by interconnected, elongated legs, one of said legs being recessed intermediate the ends thereof to present said spaced, opposed, face-engaging surfaces.

* * * * *